US005112797A

United States Patent [19]

Takahashi et al.

[11] Patent Number: 5,112,797

[45] Date of Patent: May 12, 1992

[54] DONOR SHEET FOR PRESSURE-SENSITIVE IMAGE RECORDING

[75] Inventors: Shunsuke Takahashi, Tokyo; Hirokazu Tsukahara, Ushiku, both of Japan

[73] Assignee: Mitsubishi Paper Mills Limited, Tokyo, Japan

[21] Appl. No.: 589,519

[22] Filed: Sep. 28, 1990

[30] Foreign Application Priority Data

Nov. 30, 1989 [JP] Japan ..... 1-311118

[51] Int. Cl.[5] ..... B41M 5/40

[52] U.S. Cl. ..... 503/200; 503/215; 503/226

[58] Field of Search ..... 503/200, 207, 214, 215, 503/226

[56] References Cited

U.S. PATENT DOCUMENTS 4,411,451 10/1983 Matsushita et al. ..... 428/914
4,596,996 6/1986 Sandberg et al. ..... 503/207

FOREIGN PATENT DOCUMENTS 57-43895 3/1982 Japan ..... 503/207
61-182981 8/1986 Japan ..... 503/207

*Primary Examiner*—Pamela R. Schwartz
*Attorney, Agent, or Firm*—Cushman, Darby & Cushman

[57] ABSTRACT

A donor sheet for pressure-sensitive image recording which comprises a support, an undercoating layer applied onto said support, and an overcoating layer applied onto said undercoating layer, said undercoating layer comprising microcapsules containing a solid wax, and said overcoating layer comprising microcapsules containing an image-forming component. By using said donor sheet, record images having a sufficiently high color density and a high resolution degree can be formed on a receptor sheet.

3 Claims, No Drawings

DONOR SHEET FOR PRESSURE-SENSITIVE IMAGE RECORDING

BACKGROUND OF THE INVENTION

The present invention relates to a donor sheet for pressure-sensitive image recording, and more particularly to a donor sheet for pressure-sensitive image recording giving record images of an increased density.

Hitherto, a carbon paper has been used as a pressure-sensitive image recording material, but they have exposed colored materials, so that it is easy to color and stain fingers and other articles.

Recently, however, a no carbon required paper (another name, carbonless paper) having a colorless appearance is being mainly used in which an electron-donative colorless dye and an electron-receptive developer are used in combination an image-forming components (for example, Japanese patent publication No. 37451/1971).

This colorless no carbon required paper is combination of a donor sheet and a receptor sheet, the former being usually produced by dissolving one of the image-forming components in a solvent, sealing the resulting solution into microcapsules and coating the microcapsules onto a supporting sheet, and the latter having a coating layer of the other image-forming component. When the donor sheet is laid upon the receptor sheet, and pressure is applied to the former sheet, the microcapsules at the pressure-applied portions are broken. Thus, the solution in the broken microcapsules transfers from the donor sheet to the receptor sheet and reacts with the developer to form a visible image on the receptor sheet.

Colored dyes or pigments may be used as the image-forming component (for example, Japanese Patent Application Kokai No. 39844/1987). In this case, the solution or dispersion of a colored dye or pigment is sealed into microcapsules and coated onto a supporting sheet to prepare a donor sheet. When this donor sheet is laid upon a receptor sheet which needs no developer, and then pressure is applied to it, the colored dye or pigment is transferred from the donor sheet to the receptor sheet to color the receptor sheet.

In these conventionally used techniques, the image density obtained depends first of all upon the amount of the image-forming component transferred from the donor sheet to the receptor sheet.

That is, the above no carbon required paper is designed so that the image-forming component for the receptor sheet is usually incorporated in a stoichiometric excess and reacted with the other image-forming component transferred from the donor sheet. Consequently, the image density is determined by the transfer amount.

In a case where transfer of colored dyes or pigments is utilized, it is obvious that the image intensity is determined by the transfer amount.

Hitherto, it is known that a rate at which the image-forming component sealed into the microcapsules of the donor sheet is transferred to the receptor sheet after released by rupture of the microcapsules by pressure, i.e. a transfer rate, is fairly smaller than a rate at which the released component remains in the donor sheet, and therefore that the image-forming component is not utilized in good efficiency for image forming (for example, Japanese patent publication No. 14037/1989).

Consequently, in pressure-sensitive image-recording materials such as no carbon required paper, in order to obtain a sufficiently high image density for practical use, the amount of the image-forming component to be incorporated in the donor sheet is fixed at a high level in view of the transfer rate being low. In short, this means that the image-forming component is not utilized effectively.

If the rate of transfer by applied pressure of the image-forming component to be incorporated in the donor sheet is more improved than now, the image density also improves the more, and besides the amount of the image-forming component necessary to obtain a certain image density can be reduced, which has a great significance in terms of industrial techniques.

The pressure-sensitive image-recording material will be explained here with reference to the no carbon required paper, which is a typical example of the material. Usually, the no carbon required paper comprises a top sheet (i.e. a donor sheet) and an under sheet (i.e. a receptor sheet), the former sheet having on one side a coating layer of microcapsules containing one image-forming component in solution in a solvent and the latter sheet having on one side a coating layer of the other image-forming component. The image-forming component to be incorporated in the top sheet is, in many cases, electron-donative colorless dye such as Crystal Violet Lactone, Benzoyl Leucomethylene Blue, Malachite Green Lactone, Rhodamine Anilinolactam or 3-diethylamino-6-methyl-7-anilinofluoran, but it may be an electron-receptive developer such as phenol resin or the zinc salt of salicylic acid derivatives. Further, said image-forming component may be one component of an oxidation-reduction color-development system or chelate color-development system comprising combination of a metallic compound and a ligand. The other image-forming component includes electron-receptive developers such as acid clay, activated clay, various phenol resins, the polyvalent metallic salt of salicylic acid derivatives, etc. When the both sheets are laid one upon another so that the respective coating layers face with each other, and then pressure is applied thereto by writing or impact printers, microcapsules at the pressurized portion on the top sheet are broken, and the solution of the component contained in the microcapsules is released. Some percentage of the released solution is transferred to the under sheet to develop a color thereon in the form of visible images including letters, symbols, figures, etc. At that time, if middle sheets having at one side a coating layer of microcapsules containing one image-forming component and at the other side a coating layer of the other image-forming component, are used insert between the top sheet and under sheet, many pieces of the record image are obtained.

As another example of the pressure-sensitive image-recording material, there is known a photo- and pressure-sensitive image-recording material. This material also comprises a donor sheet and a receptor sheet, the former sheet having on one side a coating layer of microcapsules containing a solution or dispersion of a colorless dye such as disclosed in Japanese patent application Kokai No. 88739/1983 or a colored dye or pigment such as disclosed in Japanese patent application Kokai No. 39844/1987 in a photocurable liquid prepolymer. When this donor sheet is exposed to light through an image pattern to cure the microcapsules at the exposed portion, and then pressure is applied to the whole surface of the donor sheet laid upon the receptor sheet, the microcapsules only at the non-exposed portion are broken and the contents of the microcapsules are released. Some percentage of the released contents is transferred to the receptor sheet to form an image. The transfer rate at this time also is not large, and a large proportion of the image-forming component is in vain without taking part in the image formation.

There are few literatures describing a method for improving the rate of transfer of the image-forming component from the donor sheet, but descriptions on the method are seen, for example, in Japanese patent application Kokai No. 43895/1982 and No. 182981/1986. The former patent discloses to simply incorporate a wax in the coating layer of the donor sheet. The method of the former patent is accompanied by a practically serious defect that since the coating layer becomes hydrophobic and water-repellent by incorporating the wax, the water-based glue (adhesive) cannot be used, and therefore that adhesion with a edge-padding glue, i.e. edge padding becomes impossible.

In the method of the latter patent, microcapsules containing as a core substance a liquid representative of which is an aliphatic hydrocarbon solvent alone are pre-coated onto the supporting sheet, and then microcapsules containing a colorless dye (coloring agent) are coated onto the above pre-coating layer. In this case the total coating amount of the microcapsules is about twice as large as that of the usual case, so that the total coating amount of the solvent also is about twice. Consequently, images obtained by application of pressure, particularly thin lines of letters and diagrams blur thick, and a record of letters of complicated strokes gives only copied letters which are obscure in the stroke, difficult to read and so poor in practical value.

SUMMARY OF THE INVENTION

An object of the present invention is to provide a donor sheet for pressure-sensitive image recording which remarkably improves the transfer rate of the image-forming component, does not make the coating layer hydrophobic and produces no thickly blurred recording lines.

The above object is attained by providing a layer comprising solid wax-containing microcapsules between the support and a layer comprising microcapsules containing the image-forming component.

According to the present invention, there is provided a donor sheet for pressure-sensitive image recording which comprises a support, an undercoating layer applied onto said support and an overcoating layer applied onto said undercoating layer, said undercoating layer comprising microcapsules containing a solid wax and said overcoating layer comprising microcapsules containing an image-forming component.

According to the present invention, in producing the donor sheet by coating a support such as paper, film, etc. with microcapsules containing the image-forming component in combination with other materials (e.g. binders, stilt materials) and then drying the coating layer, the layer comprising microcapsules containing a solid wax is previously applied to the support before applying the layer comprising microcapsules containing the image-forming component. Since the solid wax is sealed into the microcapsules, the layer shows a hydrophilic property, not causing any hindrance to applying the layer comprising microcapsules containing the image-forming component onto the layer.

The top sheet (i.e. donor sheet) thus produced gives a remarkably high-density and sharp record image to the under sheet (i.e. receptor sheet), and besides since the coating layer shows a hydrophilic property, edge padding with a water-based glue also is easy.

DETAILED DESCRIPTION OF THE INVENTION

The present invention will be illustrated in detail below.

In the present invention, the encapsulation can be carried out, for example, by making use of the coacervation method as disclosed in U.S. Pat. No. 3,041,289, the in situ polymerization method as disclosed in U.S. Pat. Nos. 4,001,140, 4,100,103 and 4,233,178, the interfacial polymerization method as disclosed in Japanese Patent Publication No. 446/1967, or the like; however, it is not limited to these methods.

What plays an important role in the present invention is a solid wax.

As is described in "Kagaku Daijiten", published from Kyoritsu-shuppan Co., a wax in a chemically strict sense refers to an ester of a fatty acid with a water-insoluble higher monohydric or dihydric alcohol. It is classified into a solid wax and a liquid wax (e.g. sperm oil, arctic sperm oil) from its properties, and also classified into vegetable wax (e.g. carnauba wax, cotton wax) and an animal wax (e.g. bees wax, wool wax) from its origin. Usually, however, the wax does not obey the above chemical definition. For example, high-melting fats such as Japan wax are called a wax, and also montan wax and naturally and independently occurring ozokerite and petroleum wax occurring in solution in a crude petroleum, both of which are composed mainly of a hydrocarbon, are all called a wax. The petroleum wax is classified into paraffin wax, microcrystalline wax and petrolatum based on its manufacturing routes and properties. These waxes are different from the above animal and vegetable waxes in the chemical component.

The solid wax used in the present invention is a wax in a broad sense as exemplified above, but contains no liquid wax.

For sealing one or more of these solid waxes into microcapsules, it is desirable to turn the waxes into a liquid by heating at a temperature higher than the melting point, emulsify the liquid in water by means of a suitable emulsifier and then apply a microencapsulating operation. This operation is usually carried out under heating, but after completion of the operation, the waxes solidify on being cooled to room temperature.

In turning the solid wax into a liquid by heating, liquefaction of the wax becomes easy by adding a small amount of a solvent. The amount of the solvent to be added must be in a range in which the solution comprising the solid wax and solvent is sure to solidify when cooled to room temperature. Experiments show that a suitable amount of the solvent is equal to or lower than the weight of the solid wax. When the solvent is added in larger amounts than required, the thin lines of record images obtained by application of pressure get thickly blurred.

The kind of the solvent is not critical if it is unmiscible with water, and aromatic or aliphatic solvents having a boiling point of about 200° C. or more are preferred. For example, high-boiling solvents for encapsulation used in the field of no carbon required paper can be utilized as they are.

In commercial production of the pressure-sensitive image-recording material of the present invention, the undercoating layer is first produced by coating a coating solution comprising the solid wax-containing microcapsules and a binder onto a support such as paper, film, etc. To this coating solution may be added a stilt material such as starch particles in order to prevent the capsules from being broken by weak pressure. Since, however, the solid wax-containing microcapsules are hardly broken by weak pressure in themselves, a stilt material is not much required. Next, the overcoating layer is produced according to the usual method, i.e. by coating a coating solution comprising microcapsules containing the image-forming component, a binder, a stilt material, and others onto the undercoating layer thus produced.

The more the coating amount of the solid wax-containing microcapsules, the greater the effect. The coating amount, therefore, can be determined according to the object, but a coating amount equal to or lower than the amount of microcapsules containing the image-forming component is generally sufficient.

When strong pressure is applied to the donor sheet comprising the support, the undercoating layer comprising the solid wax-containing microcapsules formed on the support and the overcoating layer comprising micro-capsules containing the image-forming component formed on the undercoating layer, the microcapsules in both the layers are broken and their contents are released. It is considered at that time that since the wax is a low-polar or non-polar substance, a large amount of the image-forming component, a polar substance, is repelled toward the receptor sheet side, as a result of which the transfer rate is increased. In addition, since the solid wax-containing microcapsules are arranged at the lower side (support side), the transfer will proceed more advantageously. Further, since the wax keeps a solid state to the last, it does not instantaneously dilute the inner-phase solution of the microcapsules containing the image-forming component, so that the image obtained will be sharp.

The solid wax is covered with the microcapsule film, so that the surface of the undercoating layer keeps a hydrophilic property. Consequently, the overcoating layer can be uniformly applied onto the undercoating layer (the undercoating layer does not repel the overcoating solution), and besides the wettability of a portion, on which images have been recorded, with a water-based glue also is high.

DESCRIPTION OF THE PREFERRED EMBODIMENT

A typical example of the present invention will be shown, but the present invention is not limited thereto. In the example, parts are by weight unless otherwise stated.

(1) Production of microcapsules containing an image-forming component

Three parts of Crystal Violet Lactone (electron-donative colorless dye), an image-forming component, was dissolved in 97 parts of SAS N-296, an aromatic solvent, (trade name of a high-boiling oil produced by Nippon Sekiyu Kagaku Kogyo Co., Ltd.) and emulsified by means of a homogenizer in 100 parts of a 5% aqueous solution having a pH of 4.0 obtained by dissolving a styrene/maleic acid anhydride copolymer and a small amount of sodium hydroxide in water.

A mixture of 10 parts of melamine, 25 parts of a 37% formalin and 65 parts of water was adjusted to a pH of 9.0 with sodium hydroxide and heated to 60° C. to obtain a transparent aqueous solution of a melamine/formaldehyde initial condensate. This solution was added to the above emulsion, and the resulting mixture was stirred at 60° C. for 1 hour and then cooled to room temperature.

Thus, microcapsules of 7 μM in an average diameter containing a 3% Crystal Violet Lactone solution was prepared.

(2) Production of microcapsules containing a solid wax

As is shown in Table, Japan wax, bees wax, paraffin wax, candelilla wax, rice wax, carnauba wax and synthetic waxes were used as the solid wax. As is shown in Table, SAS N-296 (aforementioned aromatic solvent), n-tridecane (straight-chain aliphatic solvent) and IP-2028 (trade name of a branched aliphatic solvent produced by Idemitsu Sekiyu Kagaku Kogyo Co., Ltd.) were optionally used as a solvent for turning the solid wax into a liquid by heating. At that time, the weight ratio of the solid wax to the solvent was 50 parts to 50 parts, and the solid wax was turned into a liquid by heating at 80° C. The mixture of the solid wax and solvent lost flowability as the temperature decreased and took a solid form already at 45° C. When the mixture was further cooled to a vicinity of room temperature it solidified in one united body without separating into the wax and solvent.

Using 100 parts each of the liquefied waxes obtained by heating, microencapsulation was carried out in the same manner as in (1), except that the liquid temperature at the microencapsulating operation was 80° C. The average diameter of the morcrocapsules obtained was about 3 μM.

(3) Production of a donor sheet

A coating solution comprising 66 parts (as a solid matter) of the solid wax-containing microcapsules produced in (2), 12 parts (as a solid matter) of a styrene/-butadiene latex and 100 parts of water was prepared. This coating solution wa coated onto a wood free paper (basis weight: about 40 g/m$^2$)so that the microcapsules were provided in a proportion of 2 g/m$^2$.

Next, a coating solution comprising 66 parts (as a solid matter) of the microcapsules containing Crystal Violet Lactone produced in (1), 22 parts of a flour, 12 parts (as a solid matter ) of a styrene/butadiene latex and 100 parts of water was prepared. This coating solution was coated onto the undercoating layer formed above by means of a wire rod so that the dye was provided in a proportion of about 60 mg/m$^2$, and then dried.

Detailed numerical values, etc. are shown in Table together with those obtained in Comparative Examples.

(4) Evaluation of a transfer rate improving effect, etc.

The donor sheet prepared in (3) was evaluated as follows together with those obtained in Comparative Examples.

The donor sheet prepared in (3) and Super CF N40 (trade name of a receptor sheet for no carbon required paper produced by Mitsubishi Paper Mills Ltd.; basis weight, about 40 g/m$^2$) were placed one upon another so that the coating surface of the donor sheet was brought into contact with that of Super CF N40. Pressure was applied to the combined sheet by passing it through a calender of 250 kg/cm$^2$ in nip pressure to develop the receptor sheet, and the density of blue reflected light at the developed portion was measured.

The dye transfer rate was obtained as follows: The total coating amount of the dye (mg/m$^2$) was measured with the fresh sample of each donor sheet; the amount of the dye (mg/m$^2$) at the developed portions of the receptor sheet was measured; and then the dye transfer rate was expressed by the ratio (%) of the latter amount to the former amount. The determination of the dye amount was carried out by a method comprising extraction with a solvent, development with an acid and absorptiometric determination.

The contact angle was obtained by dropping distilled water or a commercialized glue (water-based edge-padding glue for no carbon required paper produced by Mitsubishi Paper Mills Ltd.) onto the coating surface of the fresh sample of each donor sheet, and then measuring the contact angle immediately after dropping by means of a contact angle tester. A smaller value of the contact angle shows a better wettability with water or the glue.

The results of the test and evaluation are shown in Table.

TABLE

| | Contents of solid wax-containing microcapsule | | Density of developed color on under sheet | Dye transfer rate | | Content angle (degree) | | Remarks |
|---|---|---|---|---|---|---|---|---|
| | Solid wax (melting point) | Solvent | | % | Relative index | Distilled water | Commercialized glue | |
| Comparative Example 1 | — | — | 0.28 | 12.6 | 100 (standard) | 70 | 35 | Blank (no undercoating layer) |
| Example 1 | Japan wax (52° C.) | — | 0.42 | 26.9 | 213 | | | |
| Example 2 | Bees wax (63° C.) | — | 0.41 | 24.2 | 192 | | | |
| Example 3 | NX-D-03[a] (45° C.) | — | 0.38 | 21.5 | 171 | | | (a): Synthetic wax produced by Noda Wax Co. |
| Example 4 | Paraffin wax L (45° C.) | — | 0.45 | 28.7 | 228 | | | |
| Example 5 | Paraffin wax H (70° C.) | — | 0.40 | 26.9 | 213 | | | |
| Example 6 | Paraffin wax H (70° C.) | SAS N-296 | 0.44 | 27.0 | 214 | | | |
| Example 7 | Paraffin wax H (70° C.) | n-Tridecane | 0.44 | 28.1 | 223 | | | |
| Example 8 | Paraffin wax H (70° C.) | IP-2028 | 0.39 | 26.9 | 213 | | | |
| Example 9 | Candelilla wax (70° C.) | — | 0.43 | 28.5 | 226 | | | |
| Example 10 | Candelilla wax (70° C.) | SAS N-296 | 0.41 | 26.8 | 213 | | | |
| Example 11 | Candelilla wax (70° C.) | n-Tridecane | 0.44 | 28.5 | 226 | | | |
| Example 12 | Candelilla wax (70° C.) | IP-2028 | 0.41 | 26.5 | 210 | | | |
| Example 13 | Rice wax (80° C.) | SAS N-296 | 0.40 | 25.2 | 200 | | | |
| Example 14 | Rice wax (80° C.) | n-Tridecane | 0.45 | 28.5 | 226 | | | |
| Example 15 | Rice wax (80° C.) | IP-2028 | 0.41 | 24.7 | 196 | | | |
| Example 16 | Carnauba wax (83° C.) | SAS N-296 | 0.41 | 23.8 | 189 | | | |
| Example 17 | Carnauba wax (83° C.) | n-Tridecane | 0.44 | 28.1 | 223 | | | |
| Example 18 | Carnauba wax (83° C.) | IP-2028 | 0.42 | 24.7 | 196 | | | |
| Example 19 | Diacarna 30L[b] (67–70° C.) | — | 0.39 | 24.2 | 192 | | | (b): Synthetic wax produced by Mitsubishi Kasei Kogyo Co. |
| Example 20 | Diacarna 30L[b] (67–70° C.) | SAS N-296 | 0.42 | 26.4 | 210 | | | |
| Example 21 | Diacarna 30L[b] (67–70° C.) | n-Tridecane | 0.46 | 28.4 | 225 | | | |
| Example 22 | Diacarna 30L[b] (67–70° C.) | IP-2028 | 0.39 | 24.9 | 198 | | | |
| Example 23 | Diacarna 30[c] (72–76° C.) | SAS N-296 | 0.41 | 24.3 | 193 | | | (c): Synthetic wax produced by Mitsubishi Kasei Kogyo Co. |
| Example 24 | Diacarna 30[c] (72–76° C.) | n-Tridecane | 0.43 | 26.5 | 210 | | | |
| Example 25 | Diacarna 30[c] (72–76° C.) | IP-2028 | 0.42 | 25.2 | 200 | | | |
| Comparative Example 2 | — | IP-2028 | 0.40 | 24.7 | 196 | | | Microcapsules in the undercoating layer contains no solid wax. |
| Comparative Example 3 | (Carnauba wax emulsion) | — | 0.30 | 15.2 | 121 | | | Overcoating layer contains a solid wax not wrapped in microcapsules (undercoating layer is not present). |
| Comparative Example 4 | Paraffin wax H | n-Tridecane | 0.30 | 13.2 | 105 | | | Overcoating layer contains solid wax-containing microcapsules (undercoating layer is not present). |

From this table, it can be seen that the donor sheets having the undercoating layer of solid wax-containing microcapsules (Examples 1 to 25) give a nearly doubled dye transfer rate as compared with the blank having no undercoating layer (Comparative Example 1). Also, it can be seen that with an increase in the dye transfer rate, the density of developed images on the receptor sheet is remarkably improved, and besides that the microcapsule-coated surface keeps a contact angle with distilled water or a water-based glue at a good level.

On the other hand, the donor sheet having the undercoating layer of microcapsules containing no solid wax, i.e. that of microcapsules containing a liquid substance (Comparative example 2) also gave the same effect as above. However, when the donor sheet was combined with the receptor sheet, and then complicated letters were printed on the combined sheets by means of an impact printer, the thin lines of the copied letters blurred thick, and the strokes of the letters were obscure and unsightly.

Contrary to this, the donor sheets of the present invention (Examples 1 to 25) gave clear-cut and sharp copied letters to the receptor sheet, so that they were very desirable.

(5) Differential thermal analysis of solid wax-containing microcapsules

Differential thermal analysis was carried out as follows on the microcapsules of Example 16 containing, as an inner-phase substance, carnauba wax and SAS N-296 in a ratio of 50 parts to 50 parts.

The water-based emulsion of the above solid wax-containing microcapsules was turned into a solid by air-drying at room temperature, and the differential heat of this solid was measured by the scanning method on a differential calorimeter (DSC-200 produced by Seiko Denshi Kogyo Co.). The comparative samples were tested similarly.

As a result, the above air-dried product of the solid wax-containing microcapsules showed a sharp endothermic peak at 74.4° C.

On the other hand, carnauba wax itself showed a sharp endothermic peak at 84.8° C., and the mixture of carbauba wax and SAS N-296 in a ratio of 50 parts to 50 parts, which has previously been molten and then solidified at room temperature, showed a sharp endothermic peak at 75.0° C.

The air-dried product of the microcapsules containing the Crystal Violet Lactone/SAS N-296 solution produced in (1) showed no sharp endothermic peak at all.

From the above results, it was found that the inner-phase substance of the solid wax-containing micro-capsules, even if it is the molten product of a solid wax/solvent mixture, solidifies in the same manner as in a case where it is not sealed into the microcapsules, and also that it shows a clear melting point although somewhat lower than that of the solid wax itself.

As described above, when a donor sheet used for pressure-sensitive image recording comprises an undercoating layer comprising a solid wax-containing microcapsules which layer is inserted between an overcoating layer comprising microcapsules containing an image-forming component and a support, the image-forming component transfers to the receptor sheet in a surprisingly high efficiency when printing pressure is applied to them. Besides, said donor sheet gives sharp pressure-sensitive record images, and particularly when a record of complicated letters is printed, it gives high-resolution copied letters.

What is claimed is:

1. A donor sheet for pressure-sensitive image recording which comprises a support, an undercoating layer applied onto said support, and an overcoating layer applied onto said undercoating layer, said undercoating layer comprising microcapsules containing a solid wax, and said overcoating layer comprising microcapsules containing an image-forming component.

2. A donor sheet according to claim 1, wherein said solid wax is Japan wax, bees wax, paraffin wax, candelilla wax, rice wax, carnauba wax or synthetic wax.

3. A donor sheet according to claim 1, wherein said microcapsules in the undercoating layer additionally contain a solvent immiscible with water.

* * * * *